US005490619A

United States Patent [19]

Boyar

[11] Patent Number: 5,490,619

[45] Date of Patent: Feb. 13, 1996

[54] DEVICE AND METHOD FOR TRANSPORTING ARTICLES

[76] Inventor: Florene E. Boyar, 13691 E. Evans, Aurora, Colo. 80014

[21] Appl. No.: 216,255

[22] Filed: Mar. 22, 1994

[51] Int. Cl.[6] ..... A45C 3/00

[52] U.S. Cl. ..... 224/153; 224/202; 224/205; 224/209; 383/4; 383/6; 383/37; 383/75; 294/141; 150/103; 150/112

[58] Field of Search ..... 224/151, 153, 224/202, 205, 209, 257–259; 383/4, 6, 37, 75; 150/103, 112; 294/141, 142

[56] References Cited

U.S. PATENT DOCUMENTS

| | | | |
|---|---|---|---|
| 2,671,486 | 3/1954 | Shaw | 224/205 |
| 2,682,290 | 6/1954 | Ditlea | 383/4 X |
| 2,871,900 | 2/1959 | Auditore | 383/4 X |
| 4,117,874 | 10/1978 | Berenguer | 383/4 X |
| 4,273,274 | 6/1981 | Freistadt | 294/141 |
| 4,515,300 | 5/1985 | Cohen | 224/151 |
| 4,674,664 | 6/1987 | Simon | 224/153 X |
| 4,782,874 | 11/1988 | Chartier | 150/112 |
| 5,009,516 | 4/1991 | Geeck | 383/37 |
| 5,030,014 | 7/1991 | Diamond et al. | 383/127 |
| 5,152,612 | 10/1992 | Shoemaker | 383/6 |
| 5,187,823 | 2/1993 | Ferguson et al. | 5/417 |

FOREIGN PATENT DOCUMENTS

| | | | |
|---|---|---|---|
| 1131258 | 10/1956 | France | 224/209 |
| 0693272 | 6/1940 | Germany | 224/209 |
| 0080550 | 8/1952 | Netherlands | 224/153 |

*Primary Examiner*—J. Casimer Jacyna
*Attorney, Agent, or Firm*—Klaas, Law, O'Meara & Malkin

[57] ABSTRACT

A device for providing a plurality of ways for transporting articles wherein a bag, which is relatively large and flexible, is contained in a purse, which is relatively small, so that the purse may be turned inside out to expose the bag and wherein the bag has an internal volume many times greater than the volume of the purse and wherein the bag has a top portion which may be opened so that articles can be placed in the bag and closed to retain the articles therein and wherein the purse is located inside of the bag when in use and wherein the bag is provided with webbing so that the bag may be carried as a backpack, a shoulder bag or a hand bag.

19 Claims, 1 Drawing Sheet

DEVICE AND METHOD FOR TRANSPORTING ARTICLES

FIELD OF THE INVENTION

This invention relates generally to the transporting of articles by an individual using such means as a backpack, shoulder bag or hand bag and more particularly to a relatively large flexible bag contained in a relatively small purse for use as a backpack, shoulder bag or hand bag when desired.

BACKGROUND OF THE INVENTION

It is recognized that backpacks, shoulder bags, hand bags and other similar products have been used by individuals for use in transporting articles from one location to another location. Under normal circumstances, these products are designed for use under one set of conditions. There has been marketed products which are provided with means for changing such products for use in various ways. In U.S. Pat. No. 4,515,500 to Cohen, there is disclosed a multi-use sports bag that has a pouch-like body having a back-pack contained therein so that the pouch-like body may be turned inside out to expose the backpack. One problem with the Cohen product is that when the backpack is in use, the original pouch-like body is located on the outer surface of the backpack. This exposes the pouch-like body so that it may be caught and broken by a protuberance when the individual is moving from one location to another. Also, since the pouch-like body is exposed, so are its contents. Therefore, there exists some need for improvements in such products.

BRIEF DESCRIPTION OF THE INVENTION

This invention provides a device for use in transporting articles from one location to another wherein a relatively large flexible bag is confined within a relatively small purse so that the relatively small purse may be turned inside out to expose the relatively large flexible bag and wherein the relatively small purse is secured to the inner surface of the relatively large bag when in use. Carrying means are provided so that the relatively large flexible bag may be used as a backpack, shoulder bag or hand bag.

In a preferred embodiment of the invention, the device comprises a purse, which is relatively small, and has an outside surface and an inside surface and an opening formed thereon. Mechanical means are provided for moving the opening between an opened position and a closed position. A bag, which is relatively large and flexible, is located within the purse. Securing means are provided for securing the purse to the bag so that the bag is available for use for holding articles when the purse is turned inside out. The bag, when available for holding articles for use, has an outer surface and an inner surface. The inside-out purse is located adjacent and opposite to at least a portion of the inner surface of the bag when the bag is available for use for holding articles. Carrying means are connected to the bag so that an individual can carry the bag to transport articles from one location to another location. The carry means are connected to the bag so that the bag may be carried as a backpack, a shoulder bag or a hand bag.

The purse, when the bag is available for holding articles, has at least one edge portion thereof secured to the bag by the securing means. The mechanical means and the opening are spaced from the edge portion so that small items may be placed in the purse inside out and be separate from articles in the bag. The bag, when available for use for holding articles, has a top portion, at least one sidewall and a bottom portion. The bag has a passageway formed therein adjacent to the top portion which passageway has opposite end openings. Adjusting means are provided and pass through the passageway for moving portions of the passageway between opened and closed positions. The carrying means comprise an elongated member having opposite end portions secured to the bag adjacent to the bottom portion and a central body portion. At least a portion of the central body portion passes through the passageway and functions as the adjusting means. The opposite end portions ar preferably secured to the bag spaced a slight distance above the bottom portion at spaced apart locations. The elongated member preferably comprises a flexible webbing material.

After articles have been placed into the bag through the top portion in the opened position, a force is applied to the bag adjacent to the opposite end openings in one direction and another force is applied to portions of the central body portion adjacent to the opposite end openings in a direction opposite to the one direction to move the material forming the passageway into a gathered-together relationship. The portions of the central body portion extending outwardly from the opposite end openings and the opposite end portions are substantially even in length so that the closed bag may be carried as a backpack or a hand bag. In another embodiment, after articles have been placed into the bag through the top portion in the opened position, a force is applied to the bag adjacent to one of the opposite end openings in one directions and another force is applied to the portion of the central body portion adjacent to the one of the opposite end openings in a direction opposite to the one direction to pull the central body portion through the passageway until one of the opposite end portions is adjacent to the other of the opposite end openings to move the material forming the passageway into a gathered-together relationship. Tihe central body portion extending out of the one of the opposite end openings may now be used as a shoulder strap for carrying the bag having the articles contained therein.

In preferred embodiments of the invention, the bag is formed from an open mesh plastic material; a synthetic paper material; leather such as a crushable chamois or any other material that may be folded to fit within the purse and then unfolded to function as described above.

In a preferred embodiment of the invention, the bag comprises a unitary piece of material folded substantially in half to have two inner surfaces facing each other. The folded unitary piece of material has two layers forming a top edge portion, opposite side edge portions, and a bottom edge portion. The opposite side edge portions are secured together so that the bag has a closed bottom portion, closed opposite side edge portions and an open top edge portion. Portions of the top edge portion are folded over to form a passageway having opposite end openings. Adjusting means are provided and pass through the passageway for moving portions of the top edge portion between opened and closed positions. The passageway having a top edge and a bottom edge and the securing means for securing the purse to the bag are located adjacent to a portion of the bottom edge of the passageway.

BRIEF DESCRIPTION OF THE DRAWINGS

Presently preferred embodiments of the invention are illustrated in the drawing in which.

DETAILED DESCRIPTION OF THE INVENTION

Figure 1:
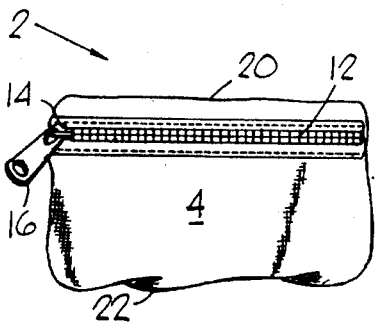
FIG. 1 is an elevational view of the purse of this invention having a bag confined therein.

In FIG. 1, there is illustrated a device 2 for providing a plurality of ways for transporting articles. The device 2 comprises a purse 4 which is relatively small. The purse 4 is made from a unitary sheet of material, such as a nylon fabric or other materials similar to those described below in relation to other portions of the device, folded upon itself with the side edges 6 and 8 seamed together. An opening 10 is formed in the purse 4 and a zipper 12 is provided for opening or closing the opening 10. The slide 14 of the zipper 12 is provided with an outer pull tab 16 and an inner pull tab 18. The zipper 10 is spaced a short distance from the upper edge portion 20. The purse 4 also has a lower edge portion 22.

Figure 2:
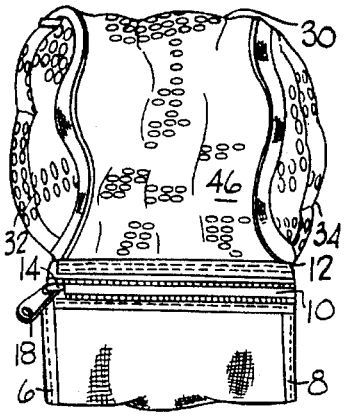
FIG. 2 is an elevational view of the purse turned inside out and a portion of the bag removed therefrom.
Figure 3:
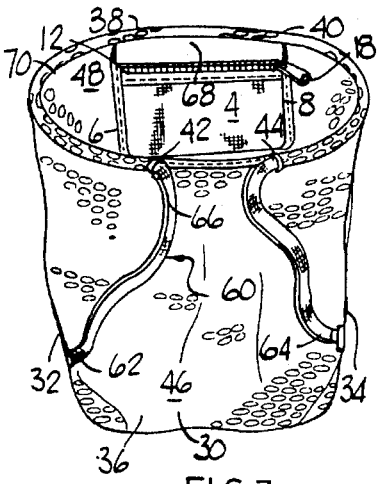
FIG. 3 is a rear elevational view of an opened backpack formed from FIG. 2.
Figure 4:
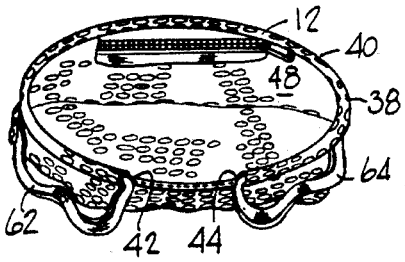
FIG. 4 is a top plan view of FIG. 3.

When the zipper 12 is opened and the purse 4 is turned inside out, as illustrated in FIGS. 1 and 2, a bag 30 can be gradually pulled out of the inside out purse 4. The bag 30 is a unitary piece of material that is folded upon itself with side edge portions 32 and 34 seamed together to form a closed bottom portion 36 and an opened top portion 38. The material at the opened top portion 38 is folded over and seamed so as to form a passageway 40 having opposite end openings 42 and 44. The bag 30 is preferably formed from an open mesh synthetic material such as a nylon mesh. Other suitable materials may be used such as a synthetic paper material such as that marketed under the trade designation Tyvek; leather, such as a crushable chamois, or other flexible but sturdy materials that can be folded upon themselves and be contained in the purse 4. The bag 30 has an outer surface 46 and an inner surface 48. As illustrated in FIG. 3, the bag 30 has a volume many times greater than the volume of the purse 4.

An elongated member 60 has opposite end portions 62 and 64 secured to the side edges 32 and 34 at locations spaced slightly above the bottom portion 36. The elongated member 60 has a central body portion 66, a portion of which is located in the passageway 40 by passing one of the opposite end portions 62 and 64 through the passageway 40 prior to securing it to one of the side edges 32 and 34. The elongated member 60 preferably comprises a webbing material such as a nylon fabric or other materials having similar characteristics.

As illustrated in FIG. 3, the purse 4 is secured to the inner surface 48 of the bag 30 by stitching 68 which preferably is adjacent to the stitching 70 forming the passageway 40 so that the inside out purse 4 is located adjacent and opposite to a portion of the inner surface 48. When the bag 30 is opened, FIG. 3, the zipper 12 may be moved to an opened position so that small items may be placed in the inside-out purse 4 and then closed, as illustrated, to maintain such items separate from the articles in the bag 30.

The purse 4 containing the bag 4 is relatively small so that a plurality of purses 4 can be conveniently carried. When it is desired to use the bag 30, the zipper 12 is opened and the purse 4 is turned inside out to make the bag 30 available. After the bag 30 has been fully withdrawn from the inside out purse 4, the bag 30 is then opened, as illustrated in FIG. 3, so that articles (not shown) may be placed in the bag 30. Also, the zipper 12 may be opened and small items placed in the inside-out purse 4. After the desired number of articles have been placed in the bag 30, the individual has the option of closing the bag 30 for use as illustrated in FIGS. 6–8.

Figure 5:
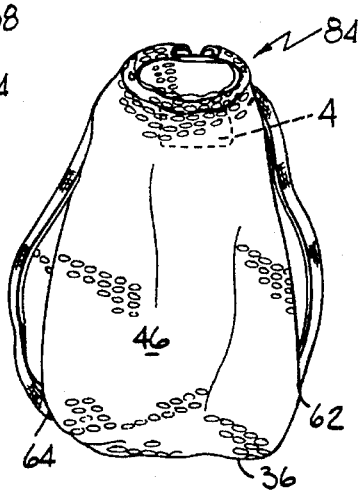
FIG. 5 is a front elevational view of FIG. 3.
Figure 6:
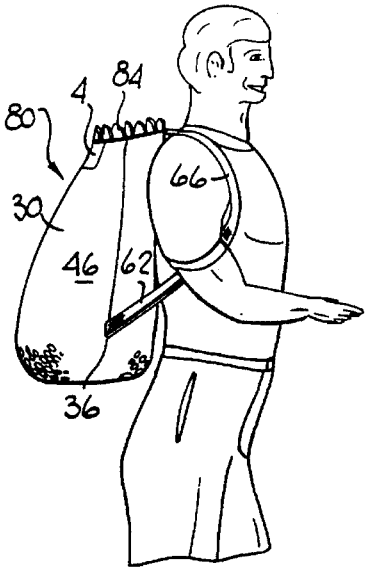
FIG. 6 is a side elevational view of FIG. 5 being used as a backpack.
Figure 7:
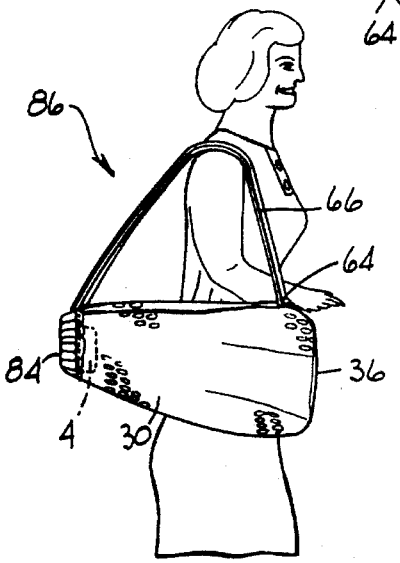
FIG. 7 is a side elevational view of the invention being used as a shoulder bag.
Figure 8:
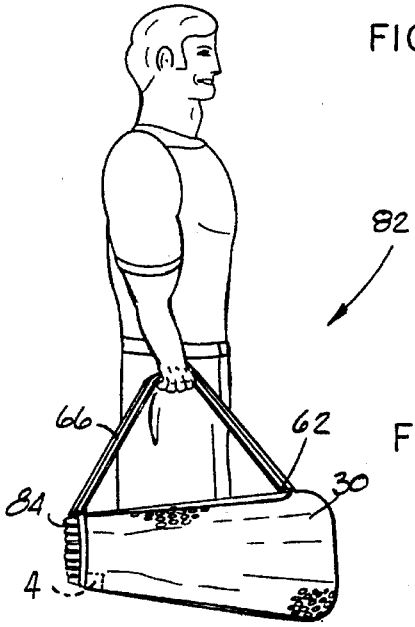
FIG. 8 is a side elevational view of the invention being used as a handbag.

When it is desired to use the bag 30 as a backpack 80, FIGS. 3 and 6, or a handbag 82, FIG. 8, the portions of the central body portion 66 adjacent to the opposite end openings 42 and 44 are brought into contact with each other. A force js applied to the portion of the passageway 40 adjacent to the opposite end openings 42 and 44 in one direction and another force is applied to the brought-together portions of the central body portion 66 in a direction opposite to the one direction. This functions to move the material forming the passageway 40 into a gathered-together relationship 84, illustrated in FIG. 5, so that no articles will fall out of the bag 30. If desired to use as a backpack 80, the portions of the central body portion 66 projecting outwardly from the gathered-together relationship and the end portions 62 and 64 are placed around the shoulder 4 of an individual. If desired to use as a handbag 82, central portions of the portions of the central body portion 66 projecting outwardly from the gathered-together relationship 84 and the opposite end portions 62 and 64 are moved together and grasped by hand.

When it is desired to use the bag 30 as a shoulder bag 86, a force is applied to the portion of the passageway 40 adjacent to one of the opposite end openings 42 and 44 in one direction and another force is applied to the portion of the central body portion 66 adjacent to the one of the opposite end portion 42 and 44 and a force is applied in the opposite direction so that the central body portion 66 moves through the passageway 40 until one of the opposite end portions 64 and 64 is adjacent to the other of the opposite end openings 42 and 44. This moves the material forming the passageway 40 into a gathered-together relationship 84. The portion of the central body portion 66 projecting outwardly from the gathered-together relationship 88 may then be placed over the shoulder of an individual so that the bag 30 functions as the shoulder bag 86. In FIGS. 7 and 8, the gathered-together relationship 84 is illustrated as being in back but it can also be located in the front.

It is contemplated that the inventive concepts herein described may be variously otherwise embodied and it is intended that the appended claims be construed to include alternative embodiments of the invention except insofar as limited by the prior art.

What is claimed is:

1. A device for providing a plurality of ways for transporting articles comprising:

a readily flexible purse being relatively small and having a first outside surface and a first inside surface and having only one closable opening formed therein;

said readily flexible purse being capable of being turned inside out so that said first outside surface becomes a second inside surface and said first inside surface becomes a second outside surface;

first mechanical means for opening or closing said only one closable opening;

a bag being relatively large and flexible being located within said purse before it is turned inside out;

securing means for securins said purse to said bag so that said bag is available for use for holding articles when said purse is turned inside out;

said bag, when available for use for holding articles, having an outer surface and an inner surface;

said purse being located to be superposed over one portion and opposite to another portion of said inner surface, when said bag is available for use for holding articles; and second mechanical means for opening or closing said only one closable opening when said purse has been turned inside out; and carrying means connected to said bag so that an individual can carry said bag in a plurality of different ways to transport articles from one location to another location.

2. A device as in claim 1 wherein:

said carrying means are connected to said bag so that said bag may be carried as a backpack.

3. A device as in claim 1 wherein:

said carrying means are connected to said bag so that said bag may be carried as a shoulder bag.

4. A device as in claim 1 wherein:

said carrying means are connected to said bag so that said bag may be carried as a hand bag.

5. A device as in claim 1 wherein:

said purse, when said bag is available for use for holding articles, having at least one edge portion secured to said bag by said securing means; and said second mechanical means and said only one closable opening being spaced from said edge portion so that items may be placed in said inside-out purse and be separate from articles in said bag.

6. A device as in claim 1 wherein:

said bag, when available for use for holding articles, having a top portion, a central portion and a bottom portion;

said bag having a passageway formed therein adjacent to said top portion;

said passageway having opposite end openings; and adjusting means passing through said passageway so that portions of said top portion can be moved between opened and closed positions.

7. A device as in claim 6 wherein said carrying means comprise:

an elongated member having opposite end portions secured to said bag adjacent to said bottom portion;

said elongated member having a central body portion; and at least a portion of said central body portion passing through said passageway and functioning as said adjusting means.

8. A device as in claim 7 wherein:

said opposite end portions being secured to said bag adjacent to said bottom portion at spaced apart locations.

9. A device as in claim 8 wherein:

said elongated continuous member comprises a flexible webbing material.

10. A device as in claim 7 wherein:

after articles have been placed into said bag through said top portion in said opened position, a force is applied to said bag adjacent to said opposite end opening in one direction and another force is applied to portions of said central body portion adjacent to said opposite end openings in a direction opposite to said one direction to move the material forming said passageway into a gathered-together relationship; and the portions of said central body portion extending outwardly from said opposite end openings and said opposite end portions being substantially even in length so that said closed bag may be carried in a plurality of different ways.

11. A device as in claim 7 wherein:

after articles have been placed into said bag through said top portion in said opened position, a force is applied to said bag adjacent to one of said opposite end openings in one direction and another force is applied to the portion of said central body portion adjacent to said one of said opposite end openings in a direction opposite to said one direction to pull said central body portion through said passageway until one of said opposite end portions is adjacent to the other of said opposite end openings to move the material forming said passageway into a gathered-together relationship; and said central body portion extending out of said one of said opposite end opening may be used as a shoulder strap for carrying said bag having said articles contained therein.

12. An article as in claim 1 wherein:

said bag is formed from an open mesh plastic material.

13. An article as in claim 1 wherein:

said bag is formed from a synthetic paper material.

14. An article as in claim 1 wherein:

said bag is formed from a crushable leather material.

15. A device as in claim 1 wherein said bag comprises:

a unitary piece of material folded to have two inner surfaces facing each other;

said folded unitary piece of material having two layers forming a top edge portion, opposite side edge portions and a bottom edge portion;

additional securing means for securing together said two layers of each of said opposite side edge portions so that said bag has a closed bottom portion, closed opposite side edge portions and an open top edge portion;

portions of said top edge portion being folded over to form a passageway having opposite end openings; and adjusting means passing through said passageway for moving portions of said top edge portion between opened and closed positions.

16. A device as in claim 15 wherein:

said passageway having a top edge and a bottom edge; and said securing means securing said inside-out purse to said bag adjacent to a portion of said bottom edge of said passageway.

17. A device as in claim 16 wherein said carrying means comprise:

an elongated continuous member having opposite end portions secured to said bag adjacent to said bottom portion;

said carrying means having a central body portion; and at least a portion of said central body portion passing through said passageway and functioning as said adjusting means.

18. A device as in claim 17 wherein:

said opposite end portions being secured to said bag adjacent to said bottom portion at spaced apart locations.

19. A device as in claim 1 and further comprising:

said bag when available for use for holding articles having a top portion, a central portion and a bottom portion;

said top portion having a passageway formed therein;

said passageway having a tope edge portion and a bottom edge portion;

said purse having a top edge portion and a bottom edge portion; and said top edge portion of said purse being secured to a portion of said bottom edge portion of said passageway.

* * * * *